US007851421B2

(12) United States Patent
Shaw et al.

(10) Patent No.: US 7,851,421 B2
(45) **Date of Patent: *Dec. 14, 2010**

(54) DETERGENT ADDITIVES FOR LUBRICATING OIL COMPOSITIONS

(75) Inventors: Robert W. Shaw, Oxfordshire (GB); Simon S. M. Chung, Oxfordshire (GB); James C. Dodd, Oxfordshire (GB); Raymond Fellows, Oxfordshire (GB)

(73) Assignee: Infineum International Limited, Oxfordshire (GB)

( * ) Notice: Subject to any disclaimer, the term of this patent is extended or adjusted under 35 U.S.C. 154(b) by 781 days.

This patent is subject to a terminal disclaimer.

(21) Appl. No.: 11/149,469

(22) Filed: Jun. 9, 2005

(65) Prior Publication Data

US 2005/0277559 A1 Dec. 15, 2005

(30) Foreign Application Priority Data

Jun. 11, 2004 (EP) ..... 04253487

(51) Int. Cl.
*C08K 5/13* (2006.01)
*C10M 105/72* (2006.01)

(52) U.S. Cl. ..... 508/585; 508/568

(58) Field of Classification Search ..... 508/585, 508/568

See application file for complete search history.

(56) References Cited

U.S. PATENT DOCUMENTS 3,256,183 A 6/1966 Greenwald ..... 252/32.7
5,259,967 A * 11/1993 Ripple ..... 508/232
5,707,946 A 1/1998 Hiebert et al. ..... 508/585
6,596,672 B1 * 7/2003 Carrick et al. ..... 508/192
6,821,933 B2 * 11/2004 Feustel et al. ..... 508/390
2006/0046941 A1 * 3/2006 Chambard et al. ..... 508/585

OTHER PUBLICATIONS

XP007124476 "Methylene-bridged alkyl phenols", Anonymous, Jun. 1999 Research Disclosure, Kenneth Mason Publications, Hampshire, GB.

* cited by examiner

*Primary Examiner*—Glenn A Caldarola
*Assistant Examiner*—Vishal Vasisth

(57) ABSTRACT

An oil-soluble hydrocarbyl phenol aldehyde condensate having the following structure:

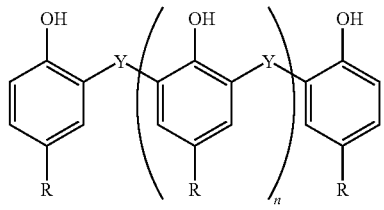

wherein n is 0 to 10, preferably 1 to 8, more preferably 2 to 6, and most preferably 3 to 5; Y is a divalent bridging group, and is preferably a hydrocarbyl group, preferably having from 1 to 4 carbon atoms; and R is a hydrocarbyl group having from 4 to 30, preferably 8 to 18, and most preferably 9 to 15 carbon atoms. The oil-soluble hydrocarbyl phenol aldehyde condensate has a weight average molecular weight (Mw) of 1250 to 1680, as measured by MALDI-TOF (Matrix Assisted Laser Desorption Ionization-Time of Flight) mass spectrometry.

13 Claims, No Drawings

DETERGENT ADDITIVES FOR LUBRICATING OIL COMPOSITIONS

The present invention relates to detergent additives for lubricating oil compositions.

Detergent additives are used in a wide variety of automotive, marine, railroad and industrial lubricants to minimize high temperature engine varnish and lacquer deposits. They are usually metal salts of sulphonates, phenates and salicylates, such as, for examples, calcium sulphurized phenates. However, the use of sulphur-containing detergents will soon be restricted due to imposed chemical limits on sulphur.

The aim of the present invention is to provide a detergent that is free of sulphur and metal (i.e. ash).

In accordance with the present invention there is provided use as a detergent in a lubricating oil composition of an oil-soluble hydrocarbyl phenol aldehyde condensate having the following structure:

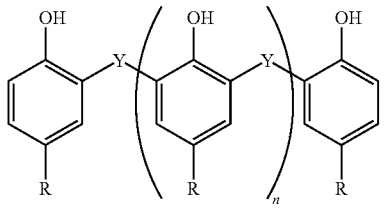

wherein n is 0 to 10, preferably 1 to 8, more preferably 2 to 6, and most preferably 3 to 5; Y is a divalent bridging group, and is preferably a hydrocarbyl group, preferably having from 1 to 4 carbon atoms; and R is a hydrocarbyl group having from 4 to 30, preferably 8 to 18, and most preferably 9 to 15 carbon atoms; the oil-soluble hydrocarbyl phenol aldehyde condensate having a weight average molecular weight (Mw) of 1250 to 1680, as measured by MALDI-TOF (Matrix Assisted Laser Desorption Ionization-Time of Flight) mass spectrometry.

The hydrocarbyl phenol aldehyde condensate has the advantage of being free of metals (such as, for example, calcium and magnesium) and sulphur. Furthermore, unlike salicylate detergents, the hydrocarbyl phenol aldehyde condensate does not exhibit negative interactions with dispersants.

The hydrocarbyl phenol aldehyde condensate is preferably a hydrocarbyl phenol formaldehyde condensate.

The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. The hydrocarbyl group is preferably composed of only hydrogen and carbon atoms. Advantageously, the hydrocarbyl group is an aliphatic group, preferably alkyl or alkylene group, especially alkyl groups, which may be linear or branched. R is preferably an alkyl or alkylene group. R is preferably branched.

In accordance with the present invention there is also provided a method of improving the detergency of a lubricating oil composition, the method including the step of adding the hydrocarbyl phenol aldehyde condensate defined above to the lubricating oil composition.

The hydrocarbyl phenol aldehyde condensate preferably has a weight average molecular weight (Mw) in the range of 1280 to 1650, preferably 1300 to 1650, more preferably 1350 to 1600, as measured by MALDI-TOF (Matrix Assisted Laser Desorption Ionization-Time of Flight) Mass Spectrometry.

The hydrocarbyl phenol aldehyde condensate is preferably obtainable by the condensation reaction between at least one aldehyde or ketone or reactive equivalent thereof and at least one hydrocarbyl phenol, in the presence of an acid catalyst such as, for example, an alkyl benzene sulphonic acid. The product is preferably subjected to stripping to remove any unreacted hydrocarbyl phenol, preferably to less than 5.0% mass, more preferably to less than 3.0% mass, even more preferably to less than 1.0% mass, of unreacted hydrocarbyl phenol. Most preferably, the product includes less than 0.5%, such as, for example, less than 0.1%, mass of unreacted hydrocarbyl phenol.

Although a basic catalyst can be used, an acid catalyst is preferred. The acid catalyst may be selected from a wide variety of acidic compounds such as, for example, phosphoric acid, sulphuric acid, sulphonic acid, oxalic acid and hydrochloric acid. The acid may also be present as a component of a solid material such as an acid treated clay. The amount of catalyst used may vary from 0.05 to 10% or more, such as for example 0.1 to 1%, by mass of the total reaction mixture.

In particular, the hydrocarbyl phenol aldehyde condensate is preferably branched dodecyl phenol formaldehyde condensate, such as, for example, a tetrapropenyl tetramer phenol formaldehyde condensate.

The hydrocarbyl phenol aldehyde condensate is preferably used in the lubricating oil composition in an amount ranging from 0.1 to 20 mass %, more preferably from 0.2 to 15 mass %, and most preferably from 0.3 to 10 mass %, based on the mass of the lubricating oil composition.

Oil of Lubricating Viscosity

The lubricating oil composition will include an oil of lubricating viscosity. The oil of lubricating viscosity (also referred to as lubricating oil) may be any oil suitable for the lubrication of automotive, marine, railroad and industrial engines. The lubricating oil may suitably be an animal, a vegetable or a mineral oil. Suitably the lubricating oil is a petroleum-derived lubricating oil, such as a naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tridecyl adipate, or polymeric hydrocarbon lubricating oils such as, for example, liquid polyisobutene and poly-alpha olefins. Commonly, a mineral oil is employed. The lubricating oil generally comprises greater than 60, typically greater than 70, mass % of the lubricant. The lubricating oil typically has a kinematic viscosity at 100° C. of from 2 to 40, for example from 3 to 15, $mm^2s^{-1}$ and a viscosity index of from 80 to 100, for example, from 90 to 95.

Another class of lubricating oils is hydrocracked oils, where the refining process further breaks down the middle and heavy distillate fractions in the presence of hydrogen at high temperatures and moderate pressures. Hydrocracked oils typically have a kinematic viscosity at 100° C. of from 2 to 40, for example from 3 to 15, $mm^2s^{-1}$ and a viscosity index typically in the range of from 100 to 110, for example from 105 to 108.

The oil may include 'brightstock' which refers to base oils that are solvent-extracted, de-asphalted products from vacuum residuum generally having a kinematic viscosity at 100° C. of from 28 to 36 $mm^2s^{-1}$ and are typically used in a proportion of less than 30, preferably less than 20, more preferably less than 15, most preferably less than 10, such as less than 5, mass %, based on the mass of the composition.

Most preferably, the oil of lubricating viscosity is present in the lubricating oil composition in an amount greater than 50 mass %, more preferably greater than 60 mass %, and most preferably greater than 65 mass %, based on the mass of the lubricating oil composition.

Detergent Additives

The lubricating oil composition may also include one or more detergent additives based on metal "soaps", that is metal salts of acidic organic compounds, sometimes referred to as surfactants.

The metal may be an alkali or alkaline earth metal such as, for example, sodium, potassium, lithium, calcium, barium and magnesium. Calcium is preferred.

The surfactant may be a salicylate, a sulphonate, a carboxylate, a phenate, a thiophosphate or a naphthenate.

The detergent may also be a complex/hybrid detergent prepared from a mixture of more than one metal surfactant, such as a calcium alkyl phenate and a calcium alkyl salicylate. Such a complex detergent is a hybrid material in which the surfactant groups, for example phenate and salicylate, are incorporated during the overbasing process. Examples of complex detergents are described in the art, such as, for example, in EP 902 827B.

Surfactants for the surfactant system of the metal detergents contain at least one hydrocarbyl group, for example, as a substituent on an aromatic ring.

The detergents may be non-sulphurized or sulphurized, and may be chemically modified and/or contain additional substituents. Suitable sulphurizing processes are well known to those skilled in the art.

The detergent may have a low TBN of from 10 to 50, a medium TBN of 50 to 150, or a high TBN of greater than 150, such as, for example, 150 to 400.

The detergents may be used in a proportion in the range of 0.5 to 30, preferably 2 to 20, or more preferably 2 to 15, mass % based on the mass of the lubricating oil composition.

Dispersant

The lubricant composition may include at least one dispersant. A dispersant is an additive for a lubricating composition whose primary function in lubricants is to accelerate neutralization of acids by the detergent system.

A noteworthy class of dispersants are "ashless", meaning a non-metallic organic material that forms substantially no ash on combustion, in contrast to metal-containing, hence ash-forming, materials. Ashless dispersants comprise a long chain hydrocarbon with a polar head, the polarity being derived from inclusion of, e.g., an O, P or N atom. The hydrocarbon is an oleophilic group that confers oil-solubility, having for example 40 to 500 carbon atoms. Thus, ashless dispersants may comprise an oil-soluble polymeric hydrocarbon backbone having functional groups that are capable of associating with particles to be dispersed.

Examples of ashless dispersants are succinimides, e.g. polyisobutene succinic anhydride; and polyamine condensation products that may be borated or unborated.

The dispersants may be used in a proportion in the range of 0 to 10.0, preferably 0.5 to 6.0, or more preferably 1.0 to 4.0, mass % based on the mass of the lubricating oil composition.

Antiwear Additives

Antiwear additives may be present in the lubricating oil composition. The antiwear additives may be metallic or non-metallic, preferably the former.

Dihydrocarbyl dithiophosphate metal salts are examples of anti-wear additives that may be used in the present invention. The metal in the dihydrocarbyl dithiophosphate metal salts may be an alkali or alkaline earth metal, or aluminium, lead, tin, molybdenum, manganese, nickel or copper. Zinc salts are preferred, preferably in the range of 0.1 to 1.5, preferably 0.5 to 1.3, mass %, based upon the total mass of the lubricating oil composition. They may be prepared in accordance with known techniques by firstly forming a dihydrocarbyl dithiophosphoric acid (DDPA), usually by reaction of one or more alcohols or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared comprising both hydrocarbyl groups that are entirely secondary and hydrocarbyl groups that are entirely primary. To make the zinc salt, any basic or neutral zinc compound may be used but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates are oil-soluble salts of dihydrocarbyl dithiophosphoric acids and may be represented by the following formula:

$$[(RO)(R^1O)P(S)S]_2Zn$$

where R and $R^1$ may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and $R^1$ groups are alkyl groups of 2 to 8 carbon atoms. Thus, the radicals may, for example, be ethyl, n-propyl, I-propyl, n-butyl, I-butyl, sec-butyl, amyl, n-hexyl, I-hexyl, n-octyl, decyl, dodecyl, octadecyl, 2-ethylhexyl, phenyl, butylphenyl, cyclohexyl, methylcyclopentyl, propenyl, butenyl. In order to obtain oil-solubility, the total number of carbon atoms (i.e. in R and $R^1$) in the dithiophoshoric acid will generally be 5 or greater. The zinc dihydrocarbyl dithiophosphate can therefore comprise zinc dialkyl dithiophosphates.

The antiwear additive may be used in a proportion in the range of 0.1 to 1.5, preferably 0.2 to 1.3, or more preferably 0.5 to 0.9, mass % based on the mass of the lubricating oil composition.

Antioxidants

Antioxidants may also be added to the lubricating oil composition. These may be aminic or phenolic. Examples of aminic include secondary aromatic amines such as diarylamines, for example diphenylamines wherein each phenyl group is alkyl-substituted with an alkyl group having 4 to 15 carbon atoms. Examples of phenolics include hindered phenols, including mono-phenols and bis-phenols. The anti-oxidant may be present in an amount of up to 3 mass %.

One or more of the following additives may also be present in the lubricating oil composition: pour point depressants such as poly(meth)acrylates or alkyl aromatic polymers; anti-foaming agents such as silicone anti-foaming agents; viscosity index improvers such as olefin copolymers; dyes; metal deactivators such as aryl thiazines, triazoles or alkyl substituted dimercapto thiadiazoles; and demulsifiers.

It may be desirable to prepare an additive package or concentrate of the lubricating oil composition. The additive package may be added simultaneously to the base oil to form the lubricating oil composition. Dissolution of the additive package into the lubricating oil may be facilitated by solvents and by mixing accompanied with mild heating. The additive package will typically be formulated to contain the detergent in proper amounts to provide the desired concentration, and/ or to carry out the intended function in the final formulation when the additive package is combined with a predetermined amount of base lubricant. The additive package may contain active ingredients in an amount, based on the additive package, of, for example, from 2.5 to 90, preferably from 5 to 75, most preferably from 8 to 60, mass % of additives in the appropriate proportions, the remainder being base oil.

The final formulations may typically contain about 5 to 40 mass % of the additive package, the remainder being base oil.

The terms 'oil-soluble' or 'oil-dispersable' as used herein do not necessarily indicate that the compounds or additives are soluble, dissolvable, miscible or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The invention will be further described, by way of example only, with reference to the following examples:

Preparation of Hydrocarbyl Phenol Aldehyde Condensates

Reaction Components

| | Hydrocarbyl Phenol Aldehyde Condensates | | | | |
|---|---|---|---|---|---|
| | 1100 Mw | 1300 Mw | 1500 Mw | 1585 Mw | 1700 Mw |
| Dodecylphenol | 2200 | 2200 | 2200 | 2200 | 2200 |
| Sulphonic Acid | 22 | 22 | 22 | 22 | 22 |
| Paraformaldehyde | 165 | 182 | 197 | 204 | 213 |
| Water | 550 | 550 | 550 | 550 | 550 |
| Heptane | 831 | 831 | 831 | 831 | 831 |

In the Table above, the amounts are given in grams for the reaction components for preparing hydrocarbyl phenol aldehyde condensates having weight average molecular weights (Mw) ranging from 1100 to 1700.

Method

The dodecylphenol, sulphonic acid (catalyst), paraformaldehyde, water and heptane were added to a 5 L baffled reactor with stirrer (200 rpm), nitrogen blanket (600 ml/min), condenser, Dean and Stark trap, a temperature controlling system, and Cardice/Acetone trap vacuum system. The reaction components were heated from ambient to 80° C. over 30 minutes, then heated further from 80 to 100° C. over 2 hours, during which time water was removed by azeotropic distillation. The residual heptane and dodecyl phenol were removed from the reaction mixture under reduced pressure at 200° C. Finally, the temperature was decreased to 120° C. at which point ESN 150 was added to produce the desired level of active ingredient (A.I.).

EXAMPLE 1 AND COMPARATIVE EXAMPLE 1

Lubricating oil compositions were prepared and tested in the Caterpillar 1N engine test. Both compositions have the same ash and soap levels (i.e. 1% ash and 0.9% soap).

| | Example 1 | Comparative Example 1 |
|---|---|---|
| 300 TBN Calcium sulphonate | 1.81 | 1.26 |
| 400 TBN Magnesium Sulphonate | 0.26 | 0.26 |
| 147 TBN Calcium Sulphurized Phenate | | 1.13 |
| Dodecylphenol Formaldehyde Condensate - 1585 Mw | 0.45 | 0 |
| Succinimide Dispersant | 6.10 | 6.10 |
| ZDDP Antioxidant | 1.31 | 1.31 |
| Antioxidant | 0.26 | 0.26 |
| Seals Moderator | 0.17 | 0.17 |
| SN150 Diluent | 1.84 | 1.70 |
| Group I Base Oil, 600N | 18.5 | 19.8 |
| Group I Base Oil, 150N | 61.3 | 60 |
| Viscosity Modifier | 7.8 | 7.8 |
| Pour Point Depressant | 0.2 | 0.2 |
| Ash (% mass) | 1.00 | 1.00 |
| TBN (D2896) | 8.61 | 8.65 |
| Soap (% mass) | 0.91 | 0.91 |
| Sulphur (% mass) | 0.257 | 0.284 |
| Phosphorus (% mass) | 0.105 | 0.105 |

The Caterpillar 1N engine test is designed to measure detergency. The test is made up of three detergency measurements: the amount of carbon in the top piston groove (top groove fill); the amount of heavy carbon on the top land of the piston (top land heavy carbon); and the overall piston cleanliness, measured as weighted demerits (weighted demerits, or WDN). The engine is sensitive to ash levels so both formulations were formulated to have the same ash levels.

Caterpillar 1N Engine Test Results

| | Caterpillar 1N Test Results | |
|---|---|---|
| | Example 1 | Comparative Example 1 |
| Weighted Piston Demerits (WDN) | 178.5 | 272.1 |
| Top Groove Fill (TGF) | 8 | 38 |
| Top Land Heavy Carbon (TLHC) | 0 | 4 |
| Oil Consumption 0–252 hours (g/KW-h) | 0.11 | 0.13 |
| Ring Sticking | none | none |

Only example 1, which includes the dodecylphenol formaldehyde condensate, passes all of the tests in the Caterpillar 1N Test.

EXAMPLE 2 AND COMPARATIVE EXAMPLE 2

Lubricating oil compositions were also prepared and tested in the Komatsu Hot Tube Test.

| | Example 2 | Comparative Example 2 |
|---|---|---|
| 300 TBN Calcium Sulphonate | 1.45 | 1.45 |
| 400 TBN Magnesium Sulphonate | 0.30 | 0.30 |

-continued

| | Example 2 | Comparative Example 2 |
|---|---|---|
| 147 TBN Calcium Sulphurized Phenate | — | 1.30 |
| Succinimide Dispersant | 7.00 | 7.00 |
| ZDDP Antiwear | 1.60 | 1.60 |
| Antioxidant | 0.40 | 0.40 |
| Antifoam | 0.003 | 0.003 |
| PIBSA | 0.20 | 0.20 |
| Dodecylphenol Formaldehyde Condensate (stripped to <1% alkyl phenol) Mw 1500 | 1.08 | — |
| SN 150 Diluent | 2.37 | 2.15 |
| Gp I Base Oil | Balance | Balance |

The results are shown below:

| | Example 2 | Comparative Example 2 |
|---|---|---|
| Visual Rating: 0 to 9 (0 = black and 9 = clear) @ 280° C. over 16 hours | 7 | 4 |

Effect of Weight Average Molecular Weight (Mw) on Performance of Hydrocarbyl Phenol Aldehyde Condensate The following formulations were tested to show the effect of weight average molecular weight (Mw) of the hydrocarbyl phenol aldehyde condensates ('HPAC's) on performance in the Caterpillar 1N Test:

| | Comp. 1100 Mw | 1300 Mw | 1500 Mw | 1585 Mw | Comp. 1700 Mw |
|---|---|---|---|---|---|
| 300 TBN Calcium sulphonate | 1.81 | 1.81 | 1.81 | 1.81 | 1.81 |
| 400 TBN Magnesium Sulphonate | 0.26 | 0.26 | 0.26 | 0.26 | 0.26 |
| HPAC (Mw 1100) | 0.45 | | | | |
| HPAC (Mw 1300) | | 0.45 | | | |
| HPAC (Mw 1500) | | | 0.45 | | |
| HPAC (Mw 1585) | | | | 0.45 | |
| HPAC (Mw 1700) | | | | | 0.45 |
| Succinimide Dispersant | 6.10 | 6.10 | 6.10 | 6.10 | 6.10 |
| ZDDP | 1.31 | 1.31 | 1.31 | 1.31 | 1.31 |
| Antioxidant | 0.26 | 0.26 | 0.26 | 0.26 | 0.26 |
| PIBSA | 0.17 | 0.17 | 0.17 | 0.17 | 0.17 |
| SN150 diluent | 1.70 | 1.70 | 1.70 | 1.70 | 1.70 |
| Gp I base oil | Balance | Balance | Balance | Balance | Balance |
| Ash (%) | 1.00 | 1.00 | 1.00 | 1.00 | 1.00 |
| TBN (ASTM D2896) | 8.61 | 8.61 | 8.61 | 8.61 | 8.61 |
| % Ca | 0.209 | 0.209 | 0.209 | 0.209 | 0.209 |
| % P | 0.105 | 0.105 | 0.105 | 0.105 | 0.105 |
| % S | 0.257 | 0.257 | 0.257 | 0.257 | 0.257 |
| Weighted Piston Demerits (WDN) | 229 | 218 | 170 | 179 | 266 |
| Top Groove Fill (TGF) | 62 | 15 | 12 | 8 | 25 |

As shown above, the hydrocarbyl phenol aldehyde condensates having weight average molecular weights of 1300, 1500 and 1585 show surprisingly better performance in the Caterpillar 1N test than the hydrocarbyl phenol aldehyde condensates having weight average molecular weights of 1100 and 1700.

The invention claimed is:

1. A lubricating oil composition comprising a major amount of oil of lubricating viscosity and from about 0.3 to about 1 mass % of at least one oil-soluble hydrocarbyl phenol aldehyde condensate having the following structure:

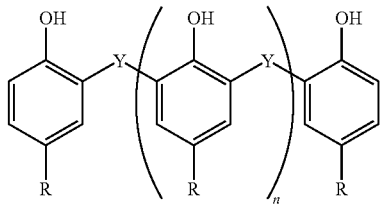

wherein n is 0 to 10; Y is a hydrocarbyl group having 1 to 4 carbon atoms; and R is a hydrocarbyl group having from 4 to 30 carbon atoms; said oil-soluble hydrocarbyl phenol aldehyde condensate having a weight average molecular weight (Mw) of 1250 to 1600, as measured by MALDI-TOF (Matrix Assisted Laser Desorption Ionization-Time of Flight) mass spectrometry.

2. The composition of claim 1, wherein R is a hydrocarbyl group having 9 to 15 carbon atoms.

3. The composition of claim 1, wherein said hydrocarbyl phenol aldehyde condensate has a number average molecular weight (Mw) in the range of 1280 to 1600, as measured by MALDI-TOF (Matrix Assisted Laser Desorption Ionization-Time of Flight) Mass Spectrometry.

4. The composition of claim 3, wherein said hydrocarbyl phenol aldehyde condensate has a number average molecular weight (Mw) in the range of 1300 to 1600, as measured by MALDI-TOF (Matrix Assisted Laser Desorption Ionization-Time of Flight) Mass Spectrometry.

5. The composition of claim 4, wherein said hydrocarbyl phenol aldehyde condensate has a number average molecular weight (Mw) in the range of 1350 to 1600, as measured by MALDI-TOF (Matrix Assisted Laser Desorption Ionization-Time of Flight) Mass Spectrometry.

6. The composition of claim 1, wherein said condensate includes less than 5.0% by mass of unreacted hydrocarbyl phenol.

7. The composition of claim 6, wherein said condensate includes less than less than 3.0% by mass of unreacted hydrocarbyl phenol.

8. The composition of claim 7, wherein said condensate includes less than 1.0% by mass, of unreacted hydrocarbyl phenol.

9. The composition of claim 1, wherein said hydrocarbyl phenol aldehyde condensate is a product of a condensation reaction between at least one aldehyde or ketone or reactive equivalent thereof and a hydrocarbyl phenol, in the presence of an acid catalyst.

10. The composition of claim 1, wherein said hydrocarbyl group in the hydrocarbyl phenol aldehyde condensate is branched.

11. The composition of claim 1, wherein said hydrocarbyl phenol aldehyde condensate is a hydrocarbyl phenol formaldehyde condensate.

12. The composition of claim 1, wherein said hydrocarbyl phenol aldehyde condensate is tetrapropenyl phenol formaldehyde condensate.

13. The composition of claim 1, wherein said lubricating oil composition further comprises at least one additive selected from the group consisting of overbased metal detergent, dispersant, antioxidant, antiwear additive, pour point depressant, antifoaming agent, viscosity index improver, dye, metal deactivator, and demulsifier.

* * * * *

UNITED STATES PATENT AND TRADEMARK OFFICE

CERTIFICATE OF CORRECTION

PATENT NO. : 7,851,421 B2
APPLICATION NO. : 11/149469
DATED : December 14, 2010
INVENTOR(S) : Robert W. Shaw et al.

It is certified that error appears in the above-identified patent and that said Letters Patent is hereby corrected as shown below:

Col. 8, in Claim 7, line 46, delete one instance of "less than".

Signed and Sealed this
Twenty-fifth Day of January, 2011

David J. Kappos

David J. Kappos
*Director of the United States Patent and Trademark Office*